US007726254B2

(12) United States Patent
Tomatsu

(10) Patent No.: US 7,726,254 B2
(45) Date of Patent: Jun. 1, 2010

(54) WINDOW REGULATOR OF AWNING FOR CRUISER

(76) Inventor: Seizou Tomatsu, 5-7, Harusato-cho, 2-chome, Chikusa-ku, Nagoya-shi, Aichi-ken 464-0038 (JP)

( * ) Notice: Subject to any disclaimer, the term of this patent is extended or adjusted under 35 U.S.C. 154(b) by 0 days.

(21) Appl. No.: 12/322,126

(22) Filed: Jan. 29, 2009

(65) Prior Publication Data

US 2009/0217860 A1 Sep. 3, 2009

(30) Foreign Application Priority Data

Mar. 3, 2008 (JP) ..... 2008-051761

(51) Int. Cl.
*B63B 17/00* (2006.01)

(52) U.S. Cl. ..... 114/361

(58) Field of Classification Search ..... 114/343, 114/361; 296/84.1, 96.13, 96.21
See application file for complete search history.

(56) References Cited

U.S. PATENT DOCUMENTS 2,821,989 A * 2/1958 Shepard ..... 114/361
6,497,191 B2 * 12/2002 Tomatsu ..... 114/361
2002/0043204 A1 4/2002 Tomatsu

FOREIGN PATENT DOCUMENTS

JP 3443397 B 6/2003

* cited by examiner

*Primary Examiner*—Lars A Olson
(74) *Attorney, Agent, or Firm*—Flynn, Thiel, Boutell & Tanis, P.C.

(57) ABSTRACT

In an awning for a cruiser, the awning including a roof frame longitudinally curved and arranged to be inclined down ahead above an open cabin; a roof cover provided to be put on the roof frame; a transparent window panel that is provided to be inclined to be continuous to the inclination of the roof frame and moves in a space between a front end of the roof frame and a front portion of the open cabin present in front of the roof frame so as to be able to slidably open and close the space; a slide rail arranged below a side frame arranged on each of left and right edges of the roof frame, a distance between the slide rail and the side frame being always constant; and a slider fixed to each of left and right sides of the window panel and slidably attached onto the slide rail, a transfer reciprocating between the front end of the roof frame and a rear portion of the roof frame along a curved shape of the roof frame is provided on the roof frame, and the window panel is connected to the transfer.

4 Claims, 13 Drawing Sheets

WINDOW REGULATOR OF AWNING FOR CRUISER

BACKGROUND OF THE INVENTION

1. Field of the Invention

The present invention relates to a window regulator for automatically opening and closing a window of an awning equipped in an open cabin of a cruiser.

2. Description of the Related Art

There are conventionally known, as a cabin of a cruiser, cabins whose overhead areas are in an open state (hereinafter, cabins of this type will be generically referred to as "open cabins") such as a main cabin equipped with a helm and provided in the open air or a main cabin having a flying deck (also called "flying bridge") mounted on a roof of the main cabin and equipped with a helm.

In an open cabin of this type, a user can do open and exhilarating steering because overhead the cabin is in an open state.

During steering in the open cabin, the user is lashed against by a strong head wind, poured with the sea spray or exposed to the sunlight. This is why an enclosure enclosing a helm position is installed in the open cabin.

While enclosures of various shapes are proposed, most of the enclosures are structured as follows. A clear vinyl sheet is stuck onto a front surface and both side surfaces of a main frame assembled into a box shape on the open cabin using a fastener and a lightproof sheet is stuck onto an upper portion of the main frame. Since the box-type enclosure apparently projects from a streamlined body of the cruiser, the box-type enclosure has problems of being poor looking and unattractive.

Furthermore, the clear vinyl sheet is made open by the fastener so as to ventilate an interior of the enclosure. However, since the cruiser is generally anchored at a marina while being left in the rain, the clear vinyl sheet deforms due to a difference in temperature or other conditions. As a result, the fastener cannot be smoothly opened or closed, thus making the enclosure less user-friendly.

Considering these problems, the applicant of the present invention developed the following awning as disclosed in Japanese Patent No. 3443397. In the awning having a transparent window panel provided in front of a lightproof roof cover arranged above an open cabin of a cruiser and slidably opening and closing a space between a front end of the roof cover and a front portion of the open cabin in front of the roof cover, the roof cover is inclined down ahead, the window panel is inclined to be continuous to inclination of the roof cover, slide rails are arranged below side frames supporting the roof cover always at constant distance to the side frames, respectively, and left and right sides of the window panel are slidably attached to the slide rails, respectively.

Many features of the awning disclosed in the Japanese Patent No. 3443397 win popularity among consumers. For example, the window panel has good opening and closing operability. The awning has a streamlined external shape that prompts the wind blowing down ahead from the window panel to the roof cover particularly when the window panel is closed.

However, in case of the conventional awning, the user is disadvantageously required to manually operate a grip provided on the window panel so as to open or close a window. The manual operation is quite cumbersome and automatic operation is desired.

SUMMARY OF THE INVENTION

It is, therefore, an object of the present invention to solve the conventional problems and improve opening and closing operability by attaching an awning-dedicated window regulator for automatically opening and closing a window panel.

To attain the object, a window regulator according to one aspect of the present invention has the following features with respect to an awning: a roof frame longitudinally curved is arranged to be inclined down ahead above an open cabin of the cruiser; a lightproof roof cover is provided to be put on the roof frame; a transparent window panel that moves in a space between a front end of the roof frame and a front portion of the open cabin present in front of the roof frame so as to be able to slidably open and close the space is provided to be inclined to be continuous to the inclination of the roof frame; a slide rail is arranged below a side frame arranged on each of left and right edges of the roof frame, a distance between the slide rail and the side frame being always constant; and a slider fixed to each of left and right sides of the window panel and slidably attached onto the slide rail, wherein a transfer reciprocating between the front end of the roof frame and a rear portion of the roof frame along a curved shape of the roof frame is provided on the roof frame, and the window panel is connected to the transfer.

Further, the transfer protrudes downward from a casing attached to a center of the roof frame as a part of the roof frame.

Furthermore, the casing includes a flat driving box and a flat driven box that are provided in a front end portion and a rear end portion thereof, respectively, wherein the flat driving box bilaterally symmetrically includes driving pulleys having driving shafts vertically, and the flat driven box bilaterally symmetrically includes driven pulleys having driven shafts vertically; four wire rows are inserted into the driving box and the driven box by winding a wire around each of the driving pulleys and each of the driven pulleys provided in front and in rear, respectively, between the driving box and the driven box; a plurality of guide pipes matched to the curved surface of the roof frame are bridged between the driving box and the driven box; slits are formed in opposing side surfaces of two central guide pipes among the plurality of guide pipes, respectively over a length direction of the guide pipes; left and right side portions of a plate-like moving member are inserted into the respective slits with margins given, the transfer being provided in the moving member; and a front end portion and a rear end portion of each of the wires are locked to front and rear ends of each of side portions of the moving member present on the guide pipes.

Moreover, a pair of moving wheels made of synthetic resin and rolling on each of the guide pipes are provided in each of left and right side portions of the moving member present inward of the two central guide pipes.

In summary, in the awning constituted as stated above and including the window regulator according to one aspect of the present invention, a transfer reciprocating between the front end of the roof frame and a rear portion of the roof frame along a curved shape of the roof frame is provided on the roof frame, and the window panel is connected to the transfer. Therefore, the window panel can be operated to be automatically slidably opened and closed by actuating the transfer.

The transfer protrudes downward from a casing attached to a center of the roof frame as a part of the roof frame. Therefore, the transfer does not narrow the space of the open cabin created by the awning and is matched to a structure of the awning. Accordingly, the transfer does not mar the beauty of the awning and is integrated with the room frame. It is, therefore, possible to improve strength of the roof frame as compared with that provided in the conventional awning.

The casing includes a flat driving box and a flat driven box that are provided in a front end portion and a rear end portion thereof, respectively, wherein the flat driving box bilaterally symmetrically includes driving pulleys having driving shafts vertically, and the flat driven box bilaterally symmetrically includes driven pulleys having driven shafts vertically; four wire rows are inserted into the driving box and the driven box by winding a wire around each of the driving pulleys and each of the driven pulleys provided in front and in rear, respectively, between the driving box and the driven box; a plurality of guide pipes matched to the curved surface of the roof frame are bridged between the driving box and the driven box; slits are formed in opposing side surfaces of two central guide pipes among the plurality of guide pipes, respectively over a length direction of the guide pipes; left and right side portions of a plate-like moving member are inserted into the respective slits with margins given, the transfer being provided in the moving member; and a front end portion and a rear end portion of each of the wires are locked to front and rear ends of each of side portions of the moving member present on the guide pipes. Therefore, the wires that move the moving member are inserted into the curved guide pipes. Further, each of the wires is not inclined in a linearly exposed state and the driving box and the driven box are flat. Due to this, the space of the open cabin created by the awning is not narrowed and there is no probability that a wire is or wires are caught in the head of a person on board. Besides, the moving member is arranged between the two central guide pipes and the left and right side portions of the moving member except for the central portion thereof from which the transfer protrudes downward are present on the guide pipes. Due to this, the casing does not mar the beauty of the awning. Moreover, a strength of the roof frame can be improved by the four guide pipes.

A pair of moving wheels made of synthetic resin and rolling on each of the guide pipes are provided in each of left and right side portions of the moving member present inward of the two central guide pipes. Therefore, the moving member can move inward of the two central guide pipes more smoothly without causing noise and vibration due to rubbing between the moving member and the two central guide pipes or without attrition of the moving member itself. In addition, the window panel can be smoothly and slidably moved. In this way, the wind regulator of the awning for the cruiser according to the present invention is quite advantageous practically.

DETAILED DESCRIPTION OF THE INVENTION

An embodiment of the present invention will be described hereinafter with reference to the accompanying drawings.

Figure 1:
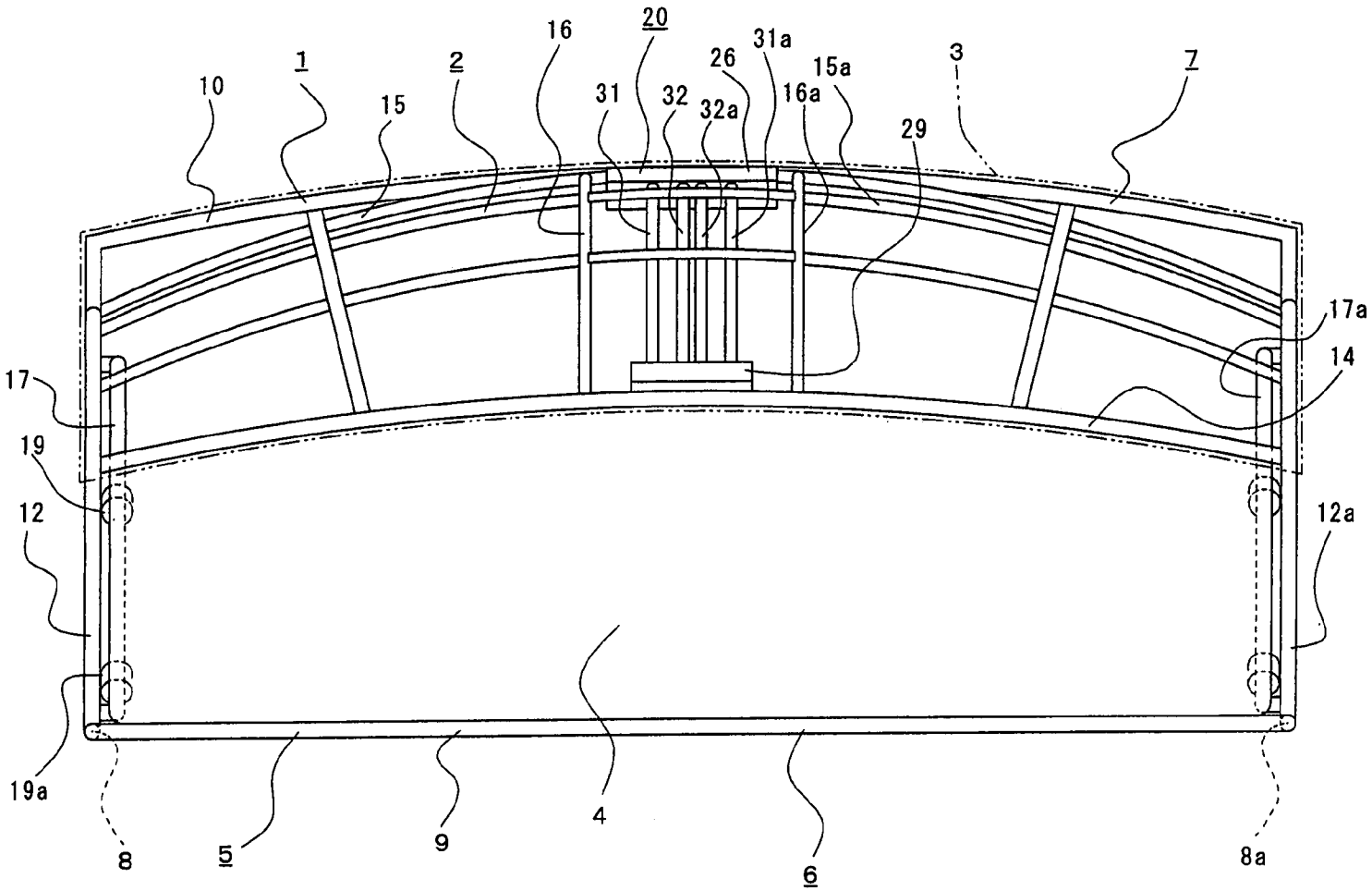
FIG. 1 is a front view of an awning to which a window regulator according to an embodiment of the present invention is attached.
Figure 2:
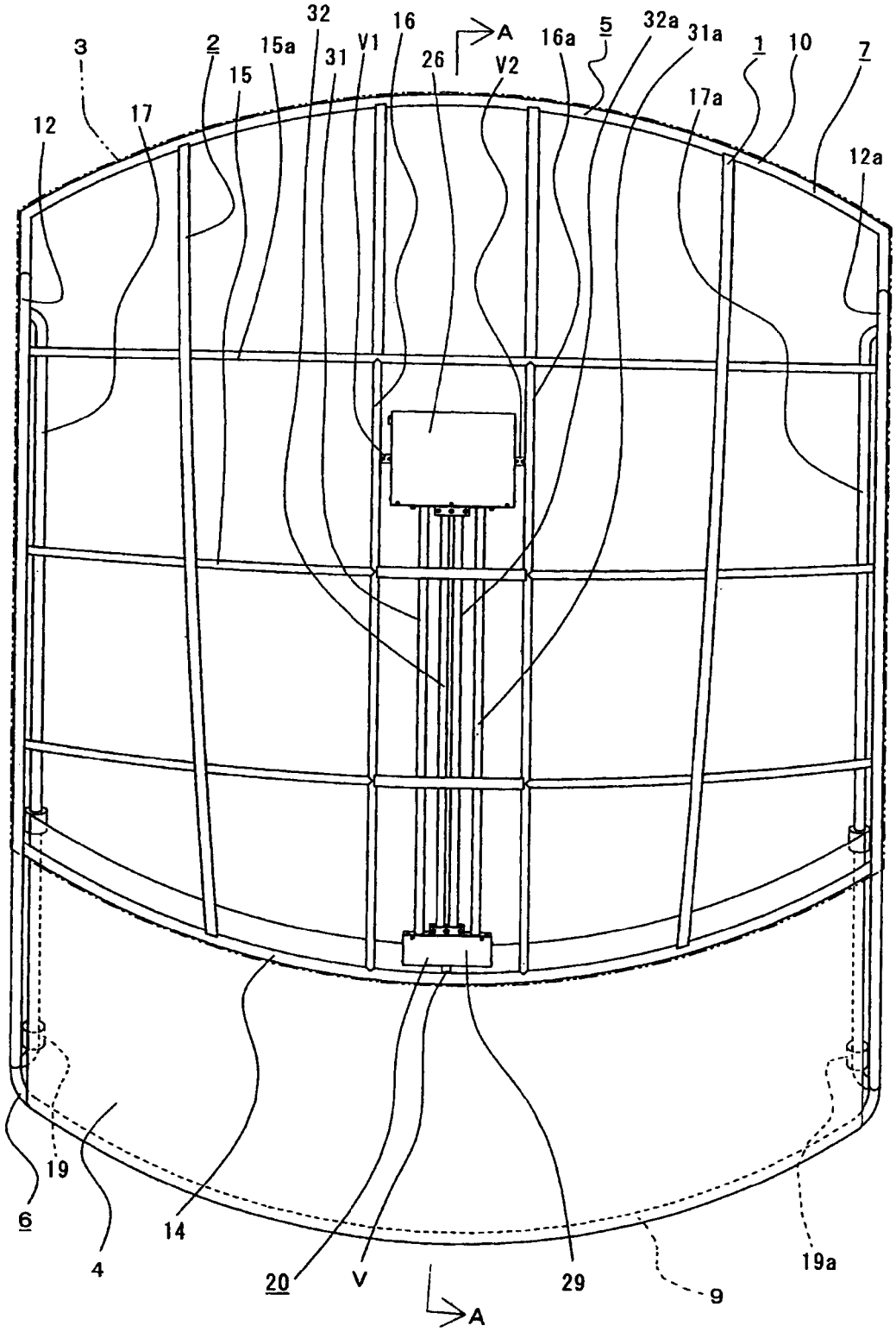
FIG. 2 is a plan view of FIG. 1.
Figure 3:
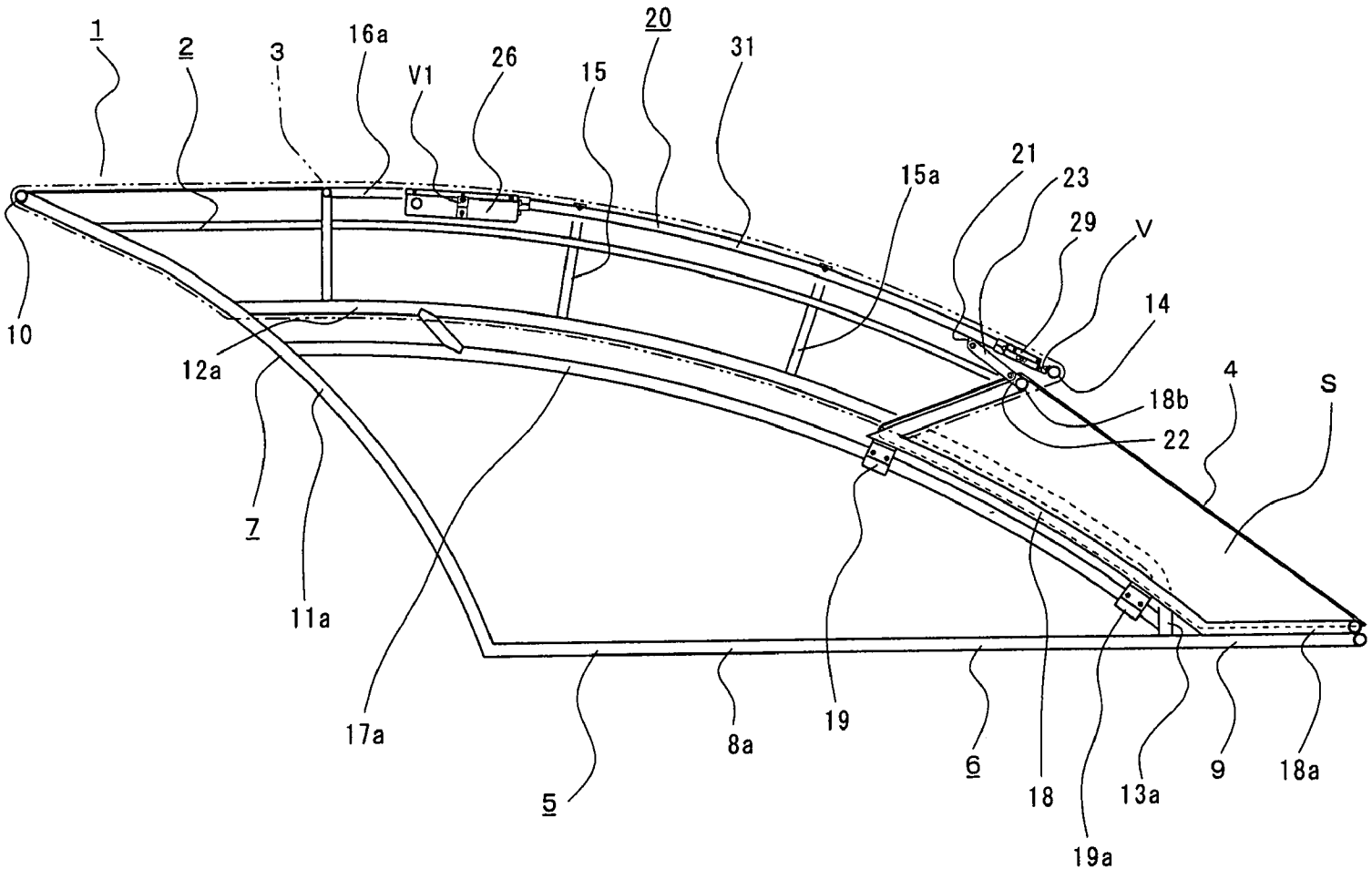
FIG. 3 is a cross-sectional view taken along a line A-A of FIG. 2.
Figure 4:
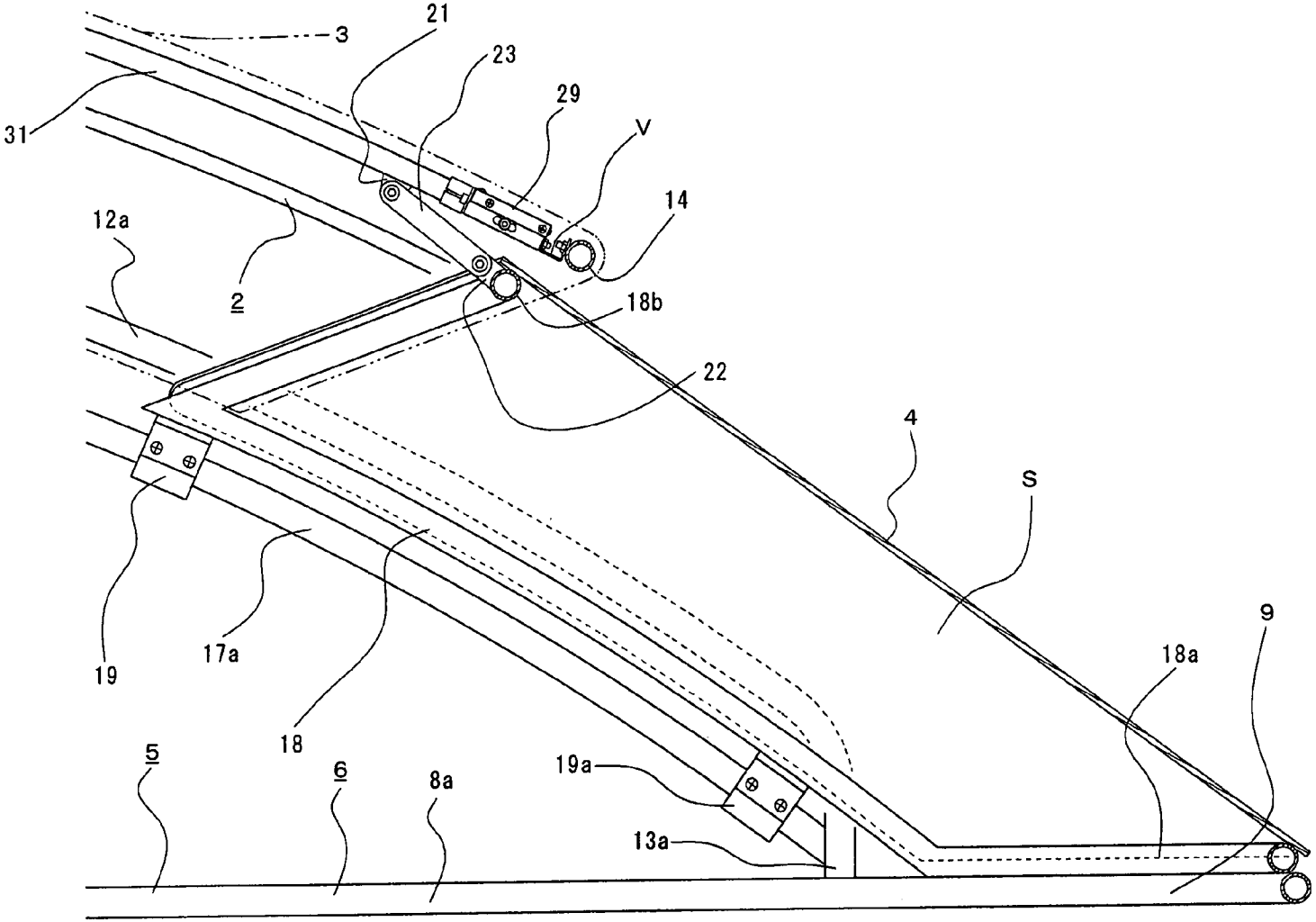
FIG. 4 is an enlarged view of principal parts of FIG. 3.

FIG. 1 is a front view of an awning to which a window regulator according to the embodiment of the present invention is attached. FIG. 2 is a plan view of FIG. 1, FIG. 3 is a cross-sectional view taken along a line A-A of FIG. 2 and FIG. 4 is an enlarged view of principal parts of FIG. 3.

An awning 1 shown in the drawings is structured as follows. A longitudinally curved roof frame 2 is arranged to be inclined down ahead above an open cabin C1 of a cruiser C shown in FIG. 14. A lightproof and waterproof sheet-like roof cover 3 is put up on the roof frame 2. Further, a transparent window panel 4 moving in a space S between a front end of the roof frame 2 and a front portion of the open cabin C1 present in front of the roof frame 2 to be able to slidably open and close the space S is provided to be inclined to be continuous to inclination of the roof frame 2 in a closed state.

In the drawings (except for FIG. 14), the roof cover 3 is indicated by a two-dot chain line for sake of description.

Figure 14:
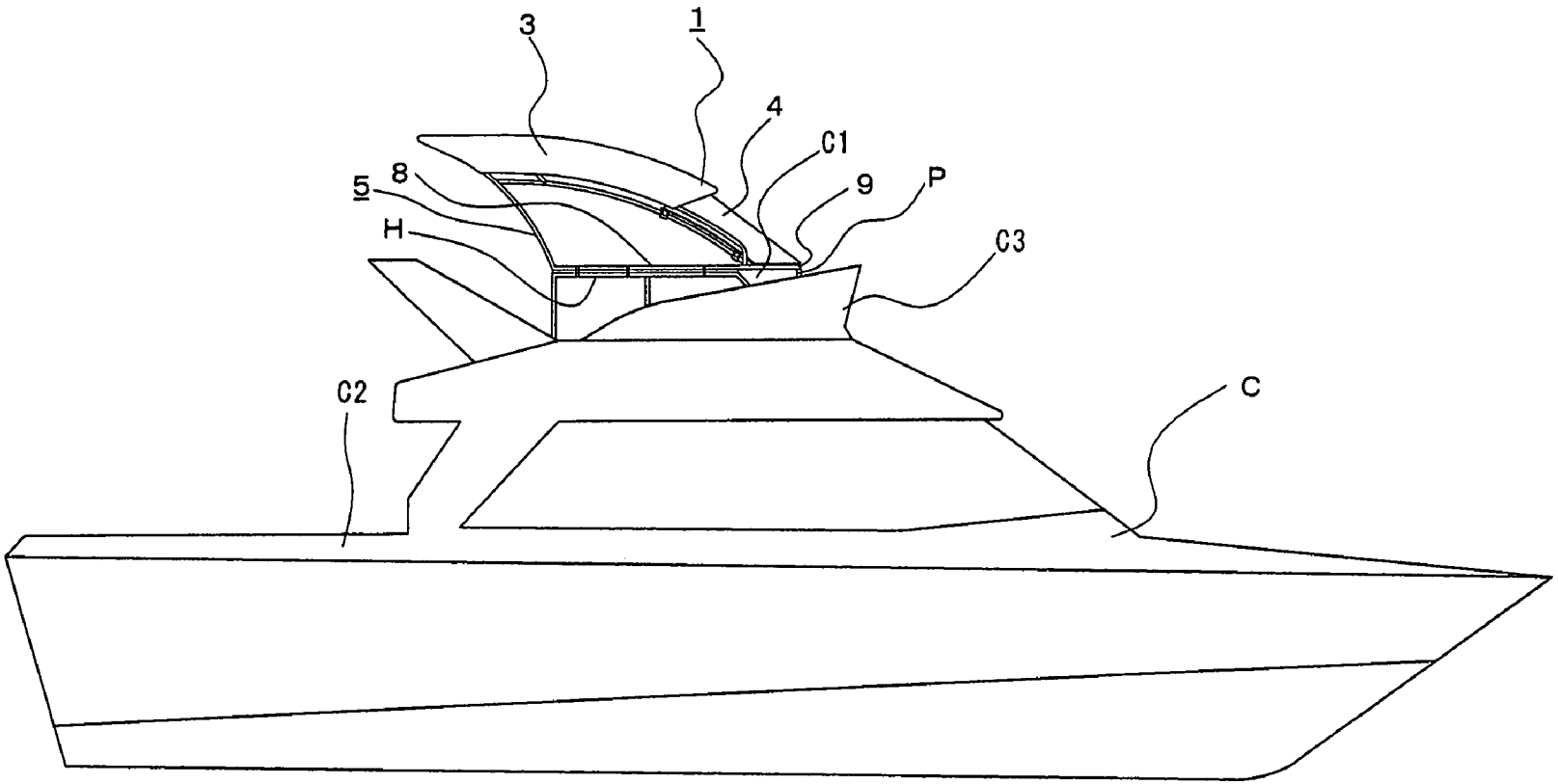
FIG. 14 is a side view of a cruiser to which the awning is attached.

The cruiser C shown in FIG. 14 is of a type having a structure in which the flying deck (open cabin C1) is provided on a roof of a main cabin. Needless to say, the awning 1 is applicable not only to the cruiser C shown in FIG. 14 but also to an arbitrary cruiser of any type, as long as the cruiser includes an open cabin of a roofless open shape.

The roof frame 2 is configured as a part of a main frame 5 to be described below.

This main frame 5 is configured so that a front frame 6 and a rear frame 7 are formed integrally. As shown in FIG. 2, the main frame 5 is formed into a generally horizontally long rectangle that has bilaterally symmetric and projecting front and rear portions in a plan view.

The front frame 6 is formed into a generally U shape by connecting parallel rods 8 and 8*a*, which are arranged left and right to be parallel to and flush with each other, to front ends of the parallel rods 8 and 8*a* by a front circular arc rod 9 curved forward.

Rear ends of the parallel rods 8 and 8*a* are formed to be continuous to the rear frame 7. The rear frame 7 is formed by forming arched rods 11 and 11*a* inclined down ahead to be arched to be continuous to an end of a rear circular arc rod 10 curved backward, having a curvature equal to that of the front circular arc rod 9 and constituting a rear end of the roof frame 2 as shown in FIG. 3. Lower ends of the arched rods 11 and 11*a* are connected to rear ends of the parallel rods 8 and 8*a* almost at right angle, respectively, thereby integrating the main frame 5.

In the main frame 5, arched side frames 12 and 12*a* gently curved are arranged to spread in ranges from the front ends of the parallel rods 8 and 8*a* to rear regions of the arched rods 11 and 11*a*, and to be parallel to each other and to be superimposed on the parallel rods 8 and 8*a* and the arched rods 11 and 11*a*, respectively. The arched side frames 12 and 12*a* constitute left and right side edges of the roof frame 2, respectively.

Standing portions 13 and 13*a* are formed out of short connection regions in which the parallel rods 8 and 8*a* are connected to front ends of the side frames 12 and 12*a* on the front ends of the side frames 12 and 12*a*, respectively.

Furthermore, an arched front frame 14 (hereinafter, also referred to as "front end 14") constituting a front end of the roof frame 2 is provided to be bridged between regions near front portions of the side frames 12 and 12*a*.

Thus, the front frame 14, the side frames 12 and 12*a* and the rear circular arc rod 10 constitute the curved roof frame 2 inclined down ahead, and the roof cover 3 is put on the roof frame 2.

As shown in FIG. 14, this roof frame 3 is configured so that the rear end of the roof cover 3 is formed to extend so as to cover up a range over a rear deck C2 of the cruiser C in a state in which the awning 1 is attached to the cruiser C.

By doing so, the roof cover 3 shields light not only at a helm position of the open cabin C1 but also over the rear deck C2 present in rear of the open cabin C1.

It is to be noted that the roof frame 2 is configured to include not only the front frame 14, the side frames 12 and 12*a* and the rear circular arc rod 10 all of which constitute an outer hull of the roof frame 2 but also a plurality of lateral support rods 15, 15*a* . . . and a plurality of longitudinal support rods 16, 16*a* . . . . The lateral support rods 15, 15*a* . . . and the longitudinal support rods 16, 16*a* . . . are appropriately arranged to cross one another so as to constitute a curved surface of the roof frame 2 between the front frame 14 and the rear circular arc rod 10 and between the side frames 12 and 12*a*.

Figure 5:
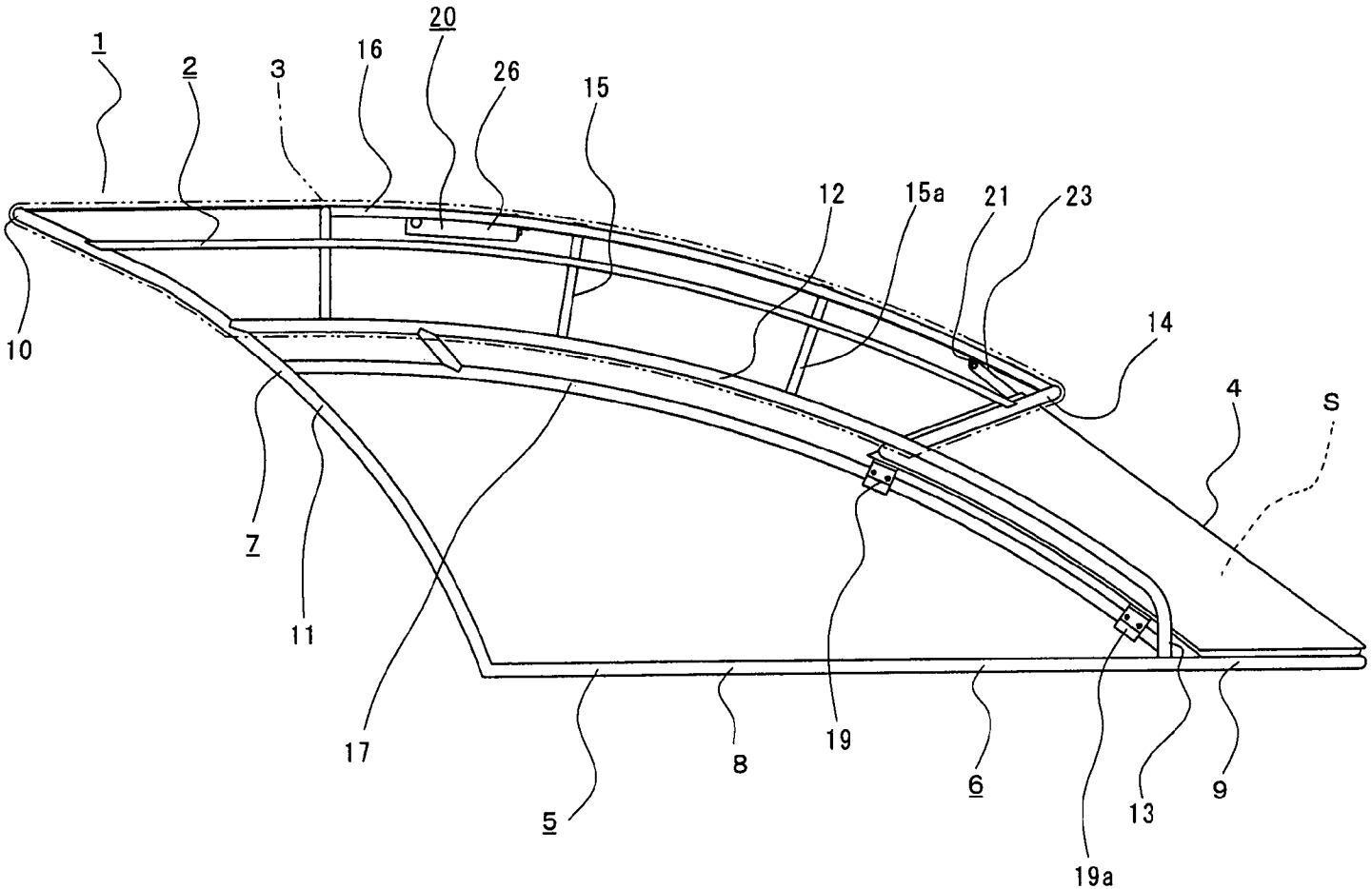
FIG. 5 is a side view of FIG. 1.

As is also shown in FIG. 5, slide rails 17 and 17*a* away from the side frames 12 and 12*a* always at constant distances are provided below the side frames 12 and 12*a*, respectively. Front and rear ends of the slide rails 17 and 17*a* are connected to the standing portions 13 and 13*a* of the side frames 12 and 12*a* and rear regions of the arched rods 11 and 11*a*, respectively.

The window panel 4, which is made of plastic such as polycarbonate, has an area almost matched to a space S surrounded by the front frame 14, the front circular arc rod 9 and the side frames 12 and 12*a*. Further, the window panel 4 is formed to be curved into an arch similarly to the front frame 14 in a horizontal direction.

A reinforcement frame 18 (partially not shown in the drawings) is provided around a lower portion of the window panel 4. Sliders 19 and 19*a* are fixed to front and rear ends of each of left and right sides of the reinforcement frame 18, respectively. The sliders 19 and 19*a* are slidably attached onto each of the slide rails 17 and 17*a* and the window panel 4 is moved along the slide rails 17 and 17*a*. By doing so, the window panel 4 can slidably open and close the space S between the front frame 14 and the front circular arc rod 9 (corresponding to the space S between the front end 14 of the roof frame 2 and a front portion of the open cabin C1).

Figure 6:
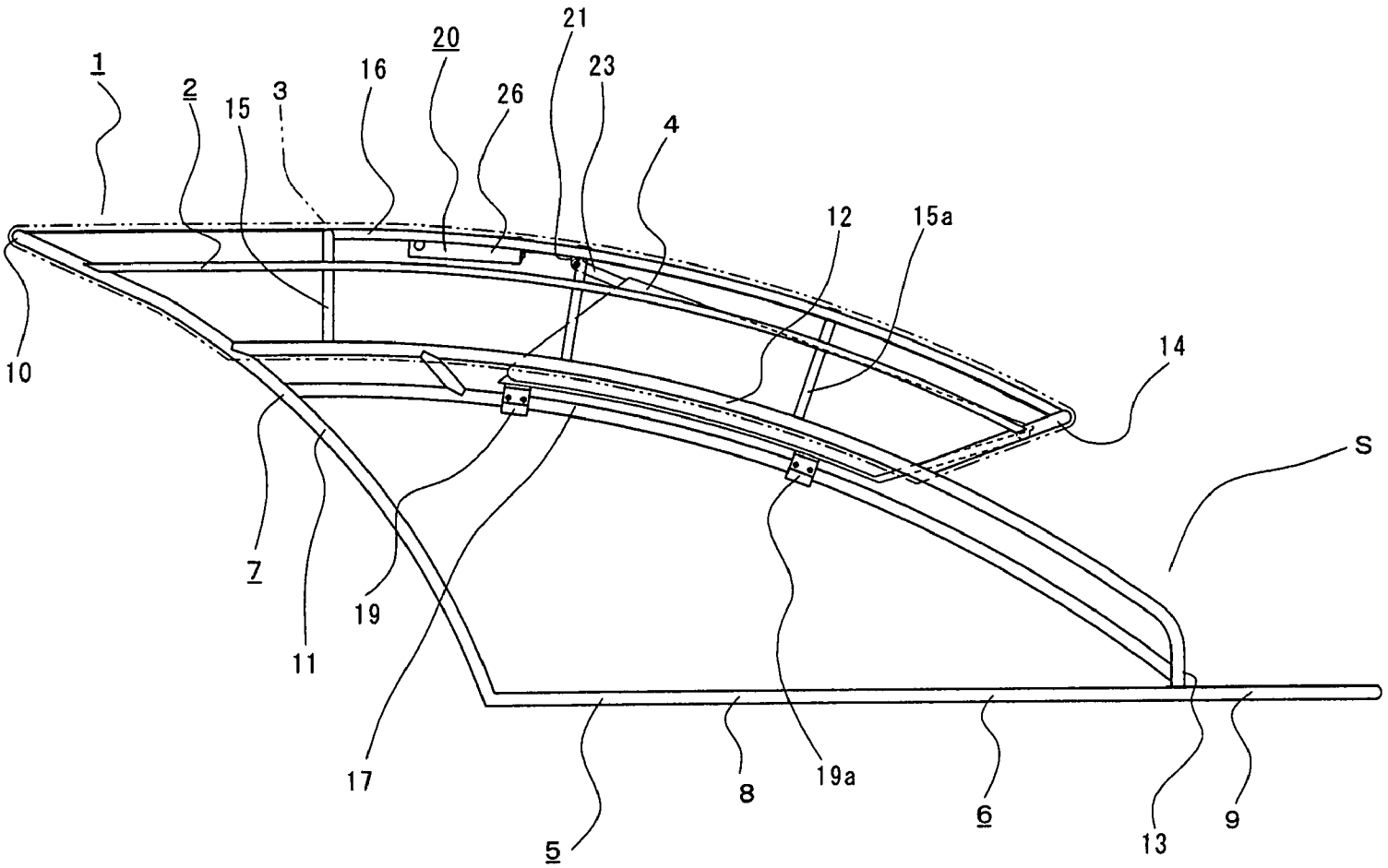
FIG. 6 is a side view of the awning in a state in which a window panel is open.
Figure 7:
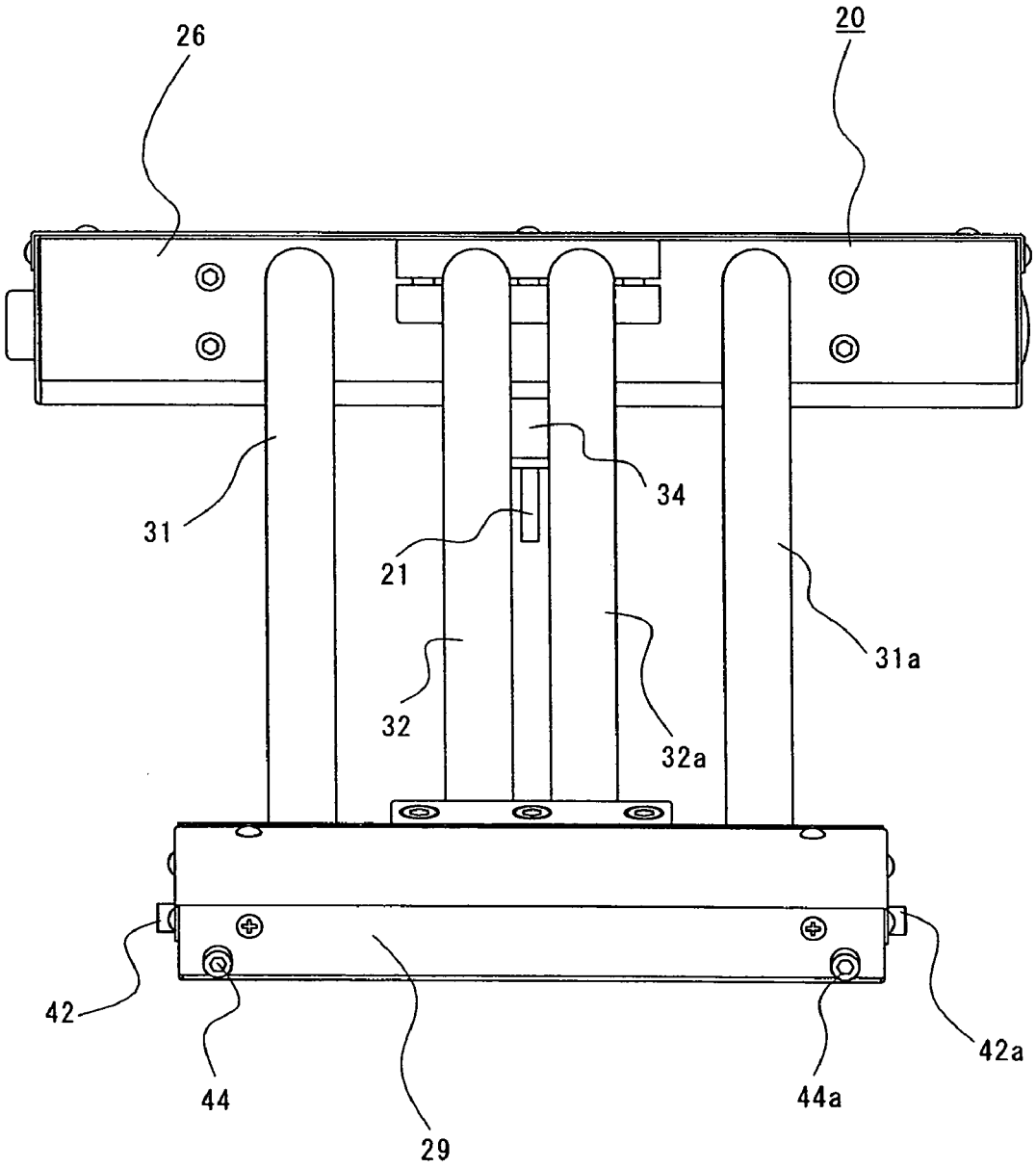
FIG. 7 is a front view of the window regulator.
Figure 8:
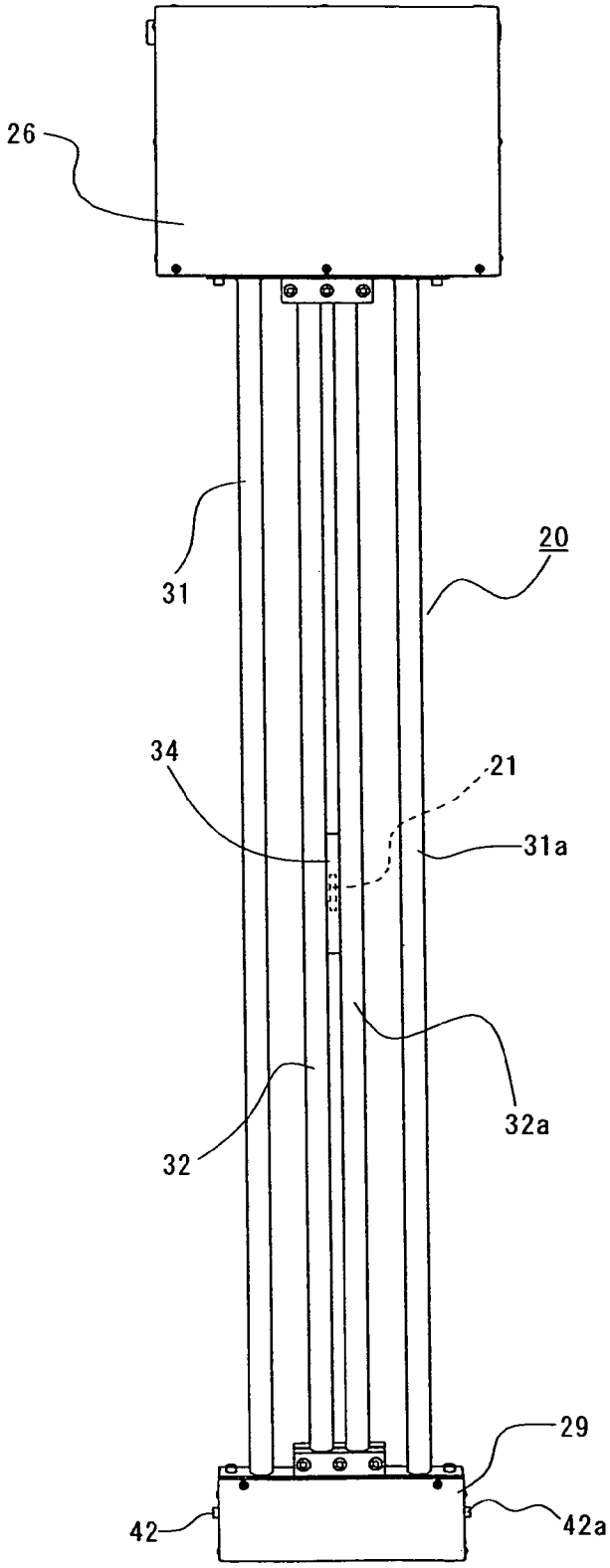
FIG. 8 is a plan view of FIG. 7.
Figure 9:
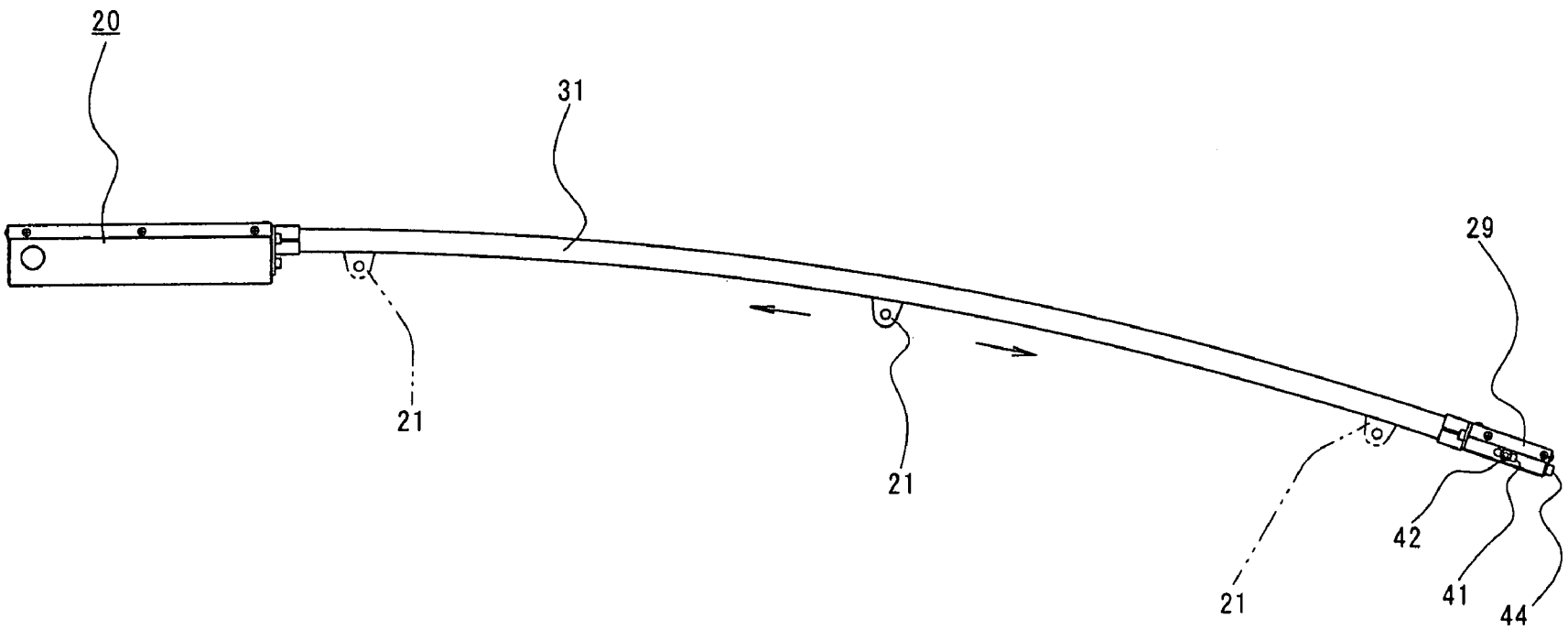
FIG. 9 is a side view of FIG. 7.

Namely, as shown in FIGS. 3 and 5, in a state in which the window panel 4 closes the space S, a front side 18*a* and a rear side 18*b* of the reinforcement frame 18 are arranged to be superimposed on an upper portion of the front circular arc rod 9 and a lower portion of the front frame 14, respectively. As shown in FIG. 6, in a state in which the window panel 4 is moved to slide rearward to open the space S, the window panel 4 is arranged to be superimposed on a lower portion of the roof frame 2 (roof cover 3) in parallel at a certain distance kept between the window panel 4 and the lower portion of the roof frame 2 (roof cover 3).

The window regulator attached to the awning 1 configured as stated above will next be described.

The window regulator is configured as follows. Referring to FIGS. 1 to 4, a transfer 21 protruding downward from a casing 20 attached to a center of the roof frame 2 as a part of the roof frame 2 is provided along a longitudinally curved shape of the roof frame 2 to freely reciprocate between the front end 14 and a rear portion of the roof frame 2. A projection piece 22 projecting rearward toward an intermediate portion of the rear side 18*b* of the reinforcement frame 18 corresponding to an upper side edge of the window panel 4 is pivotally connected to the transfer 21 via a connection rod 23, thereby connecting the transfer 21 to the window panel 4. Furthermore, as shown in FIGS. 5 and 6, the window panel 4 automatically slidably opens or closes by moving of the transfer 21.

The casing 20 is configured as follows. As shown in FIGS. 7 to 10, a flat driving box 26 in which driving pulleys 25 and 25*a* including driving shafts 24 and 24*a*, respectively are included bilaterally symmetrically is provided in a rear end portion of the casing 20 in a vertical direction. A flat driven box 29 in which driven pulleys 28 and 28*a* including driven shafts 27 and 27*a*, respectively are included bilaterally symmetrically is provided in a front end portion of the casing 20 in the vertical direction. Wires 30 and 30*a* are wound around the front and rear driving and driven pulleys 25 and 28 and around the front and rear driving and driven pulleys 25*a* and 28*a*, respectively between the driving and driven boxes 26 and 29. Four wire rows W1 to W4 are thereby inserted into the driving and driven boxes 26 and 29, respectively. In addition, guide pipes 31, 31*a*, 32 and 32*a* matched to the longitudinally curved shape of the roof frame 2 are provided to be bridged between the driving and driven boxes 26 and 29.

Slits 33 and 33*a* are formed in opposing side surfaces of the two central guide pipes 32 and 32*a* in a length direction of the guide pipes 32 and 32*a*, respectively. Left and right side portions of a plate-like moving member 34, on a central bottom of which the transfer 21 is provided, are inserted into the respective slits 33 and 33*a* with margins given. Further, loops formed on front and rear ends of each of the wires 30 and 30*a* are locked to hooks 35 and 35*a* provided on front and rear ends, respectively of each of side portions of the moving member 34 present on the guide pipes 32 and 32*a*.

If the casing 20 is to be attached to the roof frame 2, then a front wall of the driven box 29 serving as a front end portion of the casing 20 and an intermediate portion of the front frame 14 are fixed between the two longitudinal support rods 16 and 16*a* located at center of the roof frame 2 via a bracket V. Left and right sidewalls of the driving box 26 serving as a rear end portion of the casing 20 and rear side surfaces of the longitudinal support rods 16 and 16*a* are fixed between the two longitudinal support rods 16 and 16*a* located at the center of the roof frame 2 via brackets V1 and V2, respectively. Further, front and rear portions of the guide pipes 31, 31*a*, 32 and 32*a* are fixed to a lower portion of a band plate member bridged between the longitudinal support rods 16 and 16*a*. By doing so, the casing 20 can be integrated with the roof frame 2 and strength of the roof frame 2 is improved accordingly.

Figure 10:
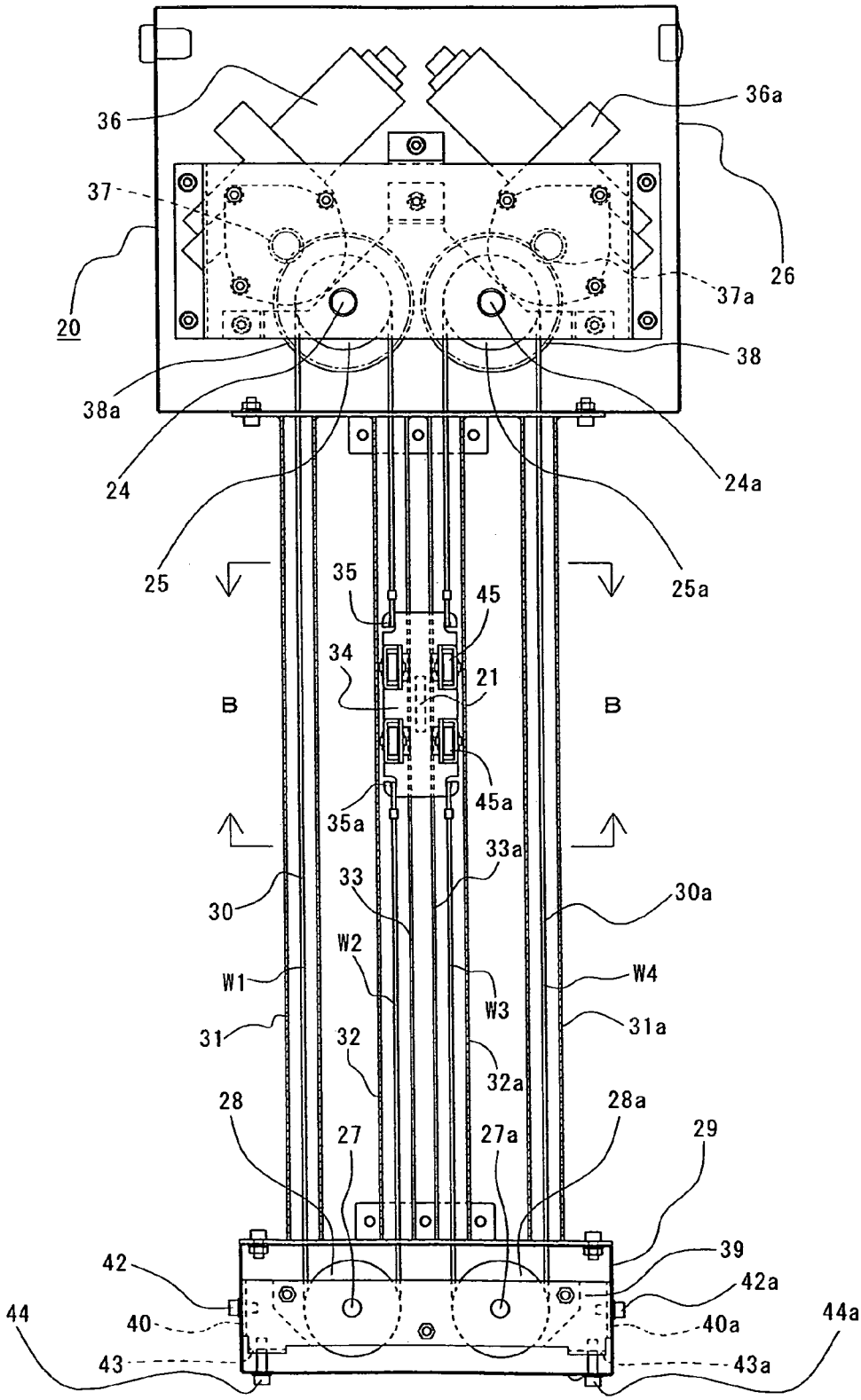
FIG. 10 is a configuration diagram showing an internal structure of the window regulator.

In FIG. 10, the guide pipes 31, 31*a*, 32 and 32*a* are short straight pipes and the driving box 26 and the driven box 29 are arranged on one horizontal surface for convenience's sake so as to explain an internal structure of the casing 20.

In the driving box 26, electrically-driven motors 36 and 36*a* are disposed to drive the driving pulleys 25 and 25*a*, respectively. Driving gears 37 and 37*a* axially attached to shafts, not shown, of the electrically-driven motors 36 and 36*a* are engaged with driven gears 38 and 38*a* coaxial with the driving pulleys 25 and 25*a*, respectively.

By actuating the electrically-driven motors 36 and 36*a*, the driving pulleys 25 and 25*a* are driven to rotate in opposite directions, the moving member 34 moves longitudinally via the wires 30 and 30*a* and the transfer 21 reciprocates between the front end 14 of the roof frame 2 and the rear portion of the roof frame 2.

It is to be noted that the respective electrically-driven motors 36 and 36*a* are set to be synchronized with each other so that the moving member 34 can smoothly move without trouble.

The driven pulleys 28 and 28*a* provided in the driven box 29 are attached to a tension bracket 39 constituted by two vertical substrates interposing driven shafts 27 and 27*a* of the driven pulleys 28 and 28*a* therebetween. Positioning bolts 42 and 42*a* inserted, from exteriorly, into a longitudinally long elongated hole 41 penetrating through left and right sidewalls of the driven box 29 are threaded with left and right sidewalls 40 and 40*a* of the tension bracket 39, respectively.

Moreover, tension bolts 44 and 44*a* inserted into a front wall of the driven box 29 from exteriorly are threaded with left and right front walls 43 and 43*a* of the tension bracket 39, respectively.

If tensions of the wires 30 and 30*a* are to be adjusted, then the positioning bolts 42 and 42*a* are temporarily loosened to turn the tension bracket 39 into a longitudinally movable state, and the tension bolts 44 and 44*a* are threaded forward or backward to thereby make fine adjustments of the tension bolts 44 and 44*a* in a longitudinal direction and relax or tense the wires 30 and 30*a*. After the adjustments, the positioning bolts 42 and 42*a* are fastened again, thereby firmly fixing the positioning-adjusted tension bracket 39 into the driven box 29.

Figure 11:
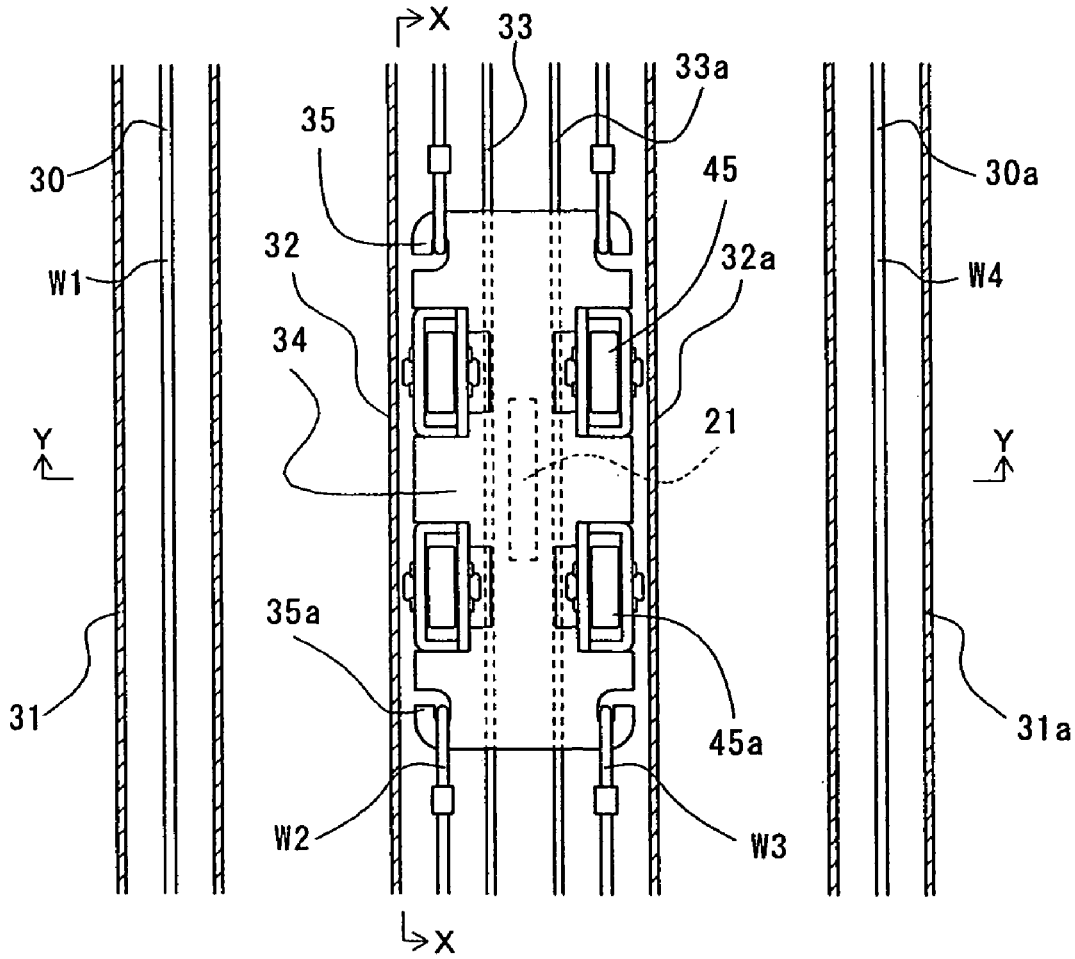
FIG. 11 is an enlarged view taken along a line B-B of FIG. 10.
Figure 12:
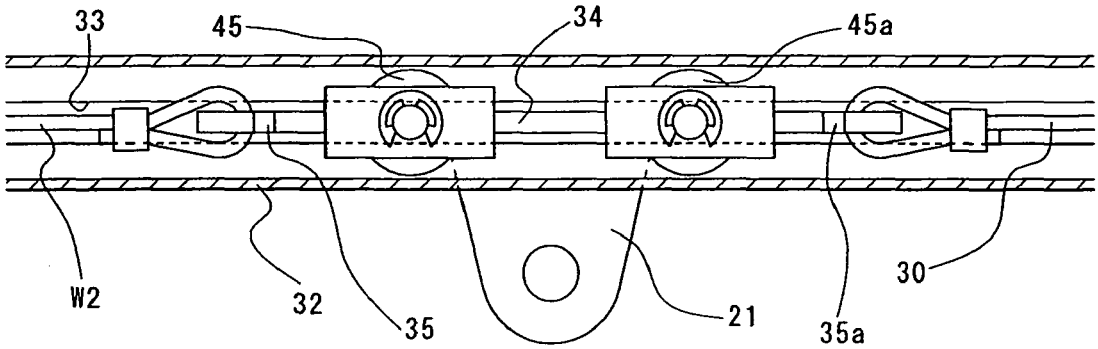
FIG. 12 is a cross-sectional view taken along a line X-X of FIG. 11.
Figure 13:
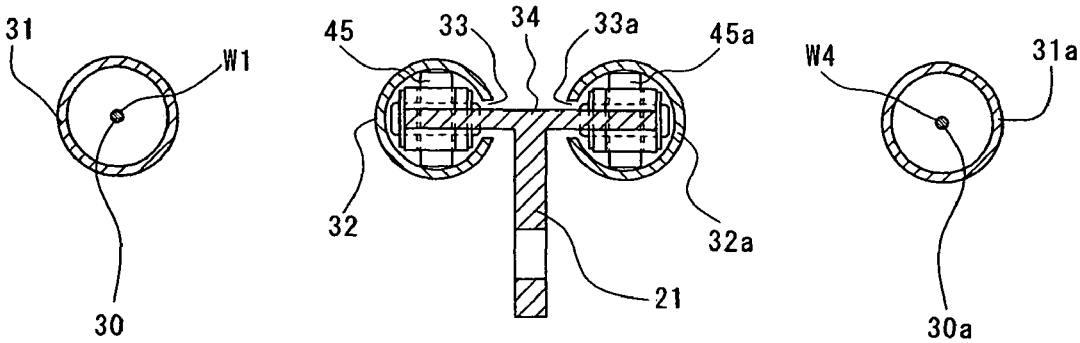
FIG. 13 is a cross-sectional view taken along a line Y-Y of FIG. 11.

As shown in FIGS. 11 to 13, the moving member 34 includes, as a substrate, a rectangular plate having its entire length and thickness set not to interfere the curved slits 33 and 33*a* during moving of the moving member 34. Further, the hooks 35 and 35*a* . . . are formed on front and rear ends of each of the left and right side portions of the moving member 34 present inward of the guide pipes 32 and 32*a*. A pair of front and rear moving wheels 45 and 45*a* made of synthetic resin and rolling on each of the guide pipes 32 and 32*a* are provided between the front and rear hooks 35 and 35*a* . . . in each side portion of the moving member 34.

By thus providing the synthetic resin moving wheels 45 and 45*a* on the moving member 34, the moving member 34 is configured to be able to move on the guide pipes 32 and 32*a* more smoothly without causing noise and vibration due to rubbing between the substrate of the moving member 34 and the two central guide pipes 32 and 32*a* during moving of the moving member 34 or without attrition of the substrate of the moving member 34.

As shown in FIG. 14, in the awning 1 equipped with the window regulator as stated above, the parallel rods 8 and 8*a* are arranged to be superimposed on and parallel to horizontal portions of handrails H already provided on left and right outer edges of the open cabin C1 of the cruiser C and are fixed by clamps.

Moreover, a pillar P connecting and supporting the front circular arc rod 9 of the main frame 5 is provided to stand in the front portion of the open cabin C1.

By doing so, the awning 1 is fixed to the open cabin C1 and configured to close the space S constituted by an upper edge of a front surface of a windshield panel C3 provided around the open cabin C1 as well as by a front end of the roof cover 3 in a state in which the window panel 4 is closed.

The open cabin C1 does not always include the handrails H depending on types of the cruiser C. If the handrails H are not provided, the front circular arc rod 9 and the parallel rods 8 and 8*a* of the main frame 5 are connected and supported by either providing upright a plurality of pillars P around the open cabin C1 or providing an appropriate base frame (not shown).

The awning 1 attached to the open cabin C1 as stated above actuates the window panel 4 to be opened or closed using the window regulator.

That is, when windshield is unnecessary, the driving and driven pulleys 25, 25*a*, 28 and 28*a* rotated by actuation of the electrically-driven motors 36 and 36*a* move the moving member 34 rearward via the wires 30 and 30*a*.

By doing so, the transfer 21 slidably moves the window panel 4 rearward via the connection rod 23 and opens the space S between the front end 14 of the roof frame 2 and the front portion of the open cabin 2 (an upper edge of a front surface of the windshield panel C3).

To close the window panel 4 from the open state as necessary, the electrically-driven motors 36 and 36*a* are actuated to rotate in the direction opposite to that stated above. Consequently, the moving member 34 is moved forward by procedures opposite to those stated above to slidably move the window panel 4 forward of the roof frame 2, thereby closing the space S.

It is to be noted that the space S can be opened at a predetermined opening degree by stopping the electrically-driven motors 36 and 36*a* during opening or closing operation of the window panel 4.

What is claimed is:

1. A window regulator of an awning for a cruiser, the awning including:

a roof frame longitudinally curved and arranged to be inclined down ahead above an open cabin of the cruiser;

a lightproof roof cover provided to be put on the roof frame;

a transparent window panel that is provided to be inclined to be continuous to the inclination of the roof frame and moves in a space between a front end of the roof frame and a front portion of the open cabin present in front of the roof frame so as to be able to slidably open and close the space;

a slide rail arranged below a side frame arranged on each of left and right edges of the roof frame, a distance between the slide rail and the side frame being always constant; and a slider fixed to each of left and right sides of the window panel and slidably attached onto the slide rail, wherein a transfer reciprocating between the front end of the roof frame and a rear portion of the roof frame along a curved shape of the roof frame is provided on the roof frame, and the window panel is connected to the transfer.

2. The window regulator of the awning for the cruiser according to claim 1, wherein the transfer protrudes downward from a casing attached to a center of the roof frame as a part of the roof frame.

3. The window regulator of the awning for the cruiser according to claim 2, wherein the casing includes a flat driving box and a flat driven box that are provided in a front end portion and a rear end portion thereof, respectively, wherein the flat driving box bilaterally symmetrically includes driving pulleys having driving shafts vertically, and the flat driven box bilaterally symmetrically includes driven pulleys having driven shafts vertically, four wire rows are inserted into the driving box and the driven box by winding a wire around each of the driving pulleys and each of the driven pulleys provided in front and in rear, respectively, between the driving box and the driven box, a plurality of guide pipes matched to the curved surface of the roof frame are bridged between the driving box and the driven box, slits are formed in opposing side surfaces of two central guide pipes among the plurality of guide pipes, respectively over a length direction of the guide pipes, left and right side portions of a moving member are inserted into the respective slits with margins given, the transfer being provided in the moving member, and a front end portion and a rear end portion of each of the wires are locked to front and rear ends of each of side portions of the moving member present on the guide pipes.

4. The window regulator of the awning for the cruiser according to claim 3, wherein a pair of moving wheels made of synthetic resin and rolling on each of the guide pipes are provided in each of left and right side portions of the moving member present inward of the two central guide pipes.

* * * * *